US007424836B2

(12) United States Patent
Takai

(10) Patent No.: US 7,424,836 B2
(45) Date of Patent: Sep. 16, 2008

(54) ANTEROPOSTERIOR POSITION VARIABLE PEDAL APPARATUS

(75) Inventor: Shinichi Takai, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/807,149

(22) Filed: May 25, 2007

(65) Prior Publication Data

US 2007/0295146 A1 Dec. 27, 2007

(30) Foreign Application Priority Data

May 30, 2006 (JP) ..... 2006-150113

(51) Int. Cl.
*G05G 1/14* (2006.01)

(52) U.S. Cl. ..... 74/512

(58) Field of Classification Search ..... 74/512, 74/516–518, 560

See application file for complete search history.

(56) References Cited

U.S. PATENT DOCUMENTS 3,643,524 A * 2/1972 Herring ..... 74/512
5,010,782 A * 4/1991 Asano et al. ..... 74/512
5,460,061 A * 10/1995 Redding et al. ..... 74/512
5,996,438 A * 12/1999 Elton ..... 74/512
6,151,985 A * 11/2000 Garber et al. ..... 74/512
6,173,625 B1 * 1/2001 McFarlane et al. ..... 74/512
6,289,761 B1 * 9/2001 Reynolds et al. ..... 74/512
6,360,629 B2 * 3/2002 Schambre et al. ..... 74/512
6,443,028 B1 * 9/2002 Brock ..... 74/512
6,584,871 B2 * 7/2003 Burton et al. ..... 74/512
6,763,741 B2 * 7/2004 Frobel et al. ..... 74/512
7,014,022 B2 * 3/2006 Sauvonnet et al. ..... 192/13 R
7,069,810 B2 * 7/2006 Hayashihara ..... 74/512
7,140,270 B2 * 11/2006 Smith et al. ..... 74/512

FOREIGN PATENT DOCUMENTS

EP 0 256 466 A2 2/1988
JP 07-334262 12/1995

* cited by examiner

*Primary Examiner*—Chong H Kim
(74) *Attorney, Agent, or Firm*—Carrier, Blackman & Associates, P.C.; Joseph P. Carrier; William D. Blackman

(57) ABSTRACT

A push link shaft 4 serving as a center of swing of push links 2*a* and 2*b* adapted to directly output a force of operating a brake master cylinder 22 is provided in a pedal apparatus, in addition to a pedal link shaft 5 serving as a center of swing of a pedal arm 7, and pedal links 3 and 3. An application point shaft 10, on which an external force received by the push link 20 and 2*b* is competitive with a force of stepping on a pedal 11, is adapted to move in an up-down direction when a slider 8, to which the pedal arm 7 is fixed, is moved along a slider rail 9.

4 Claims, 5 Drawing Sheets

ANTEROPOSTERIOR POSITION VARIABLE PEDAL APPARATUS

BACKGROUND OF THE INVENTION

1. Field of the Invention

The present invention relates to a pedal apparatus that is used to operate, for example, brakes of a vehicle, that is variable in anteroposterior position and is high in structural reliability, and that does not change a driver's operation feeling.

2. Description of Related Art

In vehicles, a driver steps on the pedal of a pedal apparatus provided below a dashboard in front of a driving seat to operate, for example, a brake. When starting to drive, the driver adjusts the driving seat to a position at which he/she can easily step on the pedal of the pedal apparatus. However, it is preferable to adjust not only the distance between the driver and the pedal apparatus but also the distance between the driver and each of driving operation apparatuses, such as a steering wheel, to appropriate values, respectively, according to the physical size and preference of the driver. Accordingly, it is desired that the pedal of the pedal apparatus can be changed in the anteroposterior position of the vehicle.

In a case where the pedal of the pedal apparatus used in a braking operation of a vehicle is adapted to be variable in the anteroposterior direction, and where the effect of the driver's stepping force, which is applied to the pedal, on the brake serving as an object to be operated is changed before or after the pedal is moved in the anteroposterior direction of the vehicle, uncomfortable operational feeling is given to the driver. Thus, there has been proposed a mechanism that enables the pedal to move in the anteroposterior direction of the vehicle, and that prevents the effect of the pedal apparatus on the object from being changed.

Both of pedal apparatuses respectively disclosed in European Patent Examined Publication EP 0 256 466 A2 and Japanese Patent Unexamined Publication JP-A-07-334262 are enabled to move a pedal in the anteroposterior direction of a vehicle and to maintain a ratio (hereunder referred to as a "lever ratio") of a distance between a swing shaft thereof and an application point, such as a brake, to which an operation is applied, to a distance between the swing shaft thereof and the pedal at a substantially constant value by moving a movement member in an up-down direction even when the pedal is moved in the anteroposterior direction of the vehicle.

However, in the case of the pedal apparatus disclosed in EP 0 256 466 A2, the swing shaft of the pedal apparatus is moved in the-up-down direction to maintain the lever ratio at a constant value even when the pedal is moved in the anteroposterior direction of the vehicle. Thus, play for the swing shaft of the pedal apparatus is easily generated. Also, play for the pedal itself is easily generated. Consequently, uncomfortable operational feeling is given to the driver.

Also, in the case of the pedal apparatus disclosed in JP-A-07-334262, a push rod for operating the brake is inclined. Thus, there is a fear of occurrence of a problem of the durability of components, such as a brake master cylinder. Additionally, there is a limitation to the adjustment to the anteroposterior position of the pedal.

SUMMARY OF THE INVENTION

The invention is accomplished to solve the problems of the conventional apparatuses. Accordingly, an object of the invention is to provide a pedal apparatus enabled to move a pedal in the anteroposterior direction of a vehicle while the lever ratio is maintained at a constant value, and to have higher reliability.

To solve the above problems, according to a first aspect of the invention, there is provided an anteroposterior position variable pedal apparatus mounted through a bracket fixed to a vehicle body frame, comprising:

a push link shaft fixed to the bracket;

a pedal link shaft which is fixed to the bracket at a position rearwardly from the push link shaft;

a push link of which one end is swingingly joined with the push link shaft;

a first connecting link of which one end is swingingly attached to the other end of the push link;

a second connecting link of which one end is swingingly joined with the pedal link;

a slider rail of which one end is fixed to the other end of the pedal link;

a slider which is engaged with the slider rail, is capable of being moved along the slider rail in an anteroposterior direction of the vehicle and is capable of being locked at an arbitrary position on the slider rail;

a pedal arm fixed to the slider; and an application point shaft joined with the other end of the second connecting link, wherein an elongated guide groove is formed in an upper portion of the pedal arm so as to be inclined in a predetermined gradient with respect to the slider rail, the pedal is fixed to a lower portion of the pedal arm, the other end of the first connecting link is swingingly joined with the application point shaft, the application point shaft engages with the guide groove, the pedal moves in the anteroposterior direction of the vehicle by changing a position of the slider along the slider rail, and while the pedal moving in the anteroposterior direction, a ratio of a distance between the pedal link shaft and the application point shaft to a distance between the pedal link shaft and the pedal is maintained at a substantially constant value, by moving the application point shaft in the guide groove.

According to a first aspect of the invention, the pedal can be moved in the anteroposterior direction of the vehicle without moving the connecting point between the swing shaft of the pedal apparatus and a push rod, while the lever ratio is maintained at a constant value.

To solve the above problems, according to a second aspect of the invention, it is preferable that the anteroposterior position variable pedal apparatus as set forth in the first aspect of the invention, further comprising:

an actuator unit which moves the slider along the slider rail and stops to lock the slider at an arbitrary point on the slider rail.

According to the second aspect of the invention, the pedal can be moved in the anteroposterior direction of the vehicle, while maintaining the lever ratio at the constant value by simple operation such as switch operation.

According to a third aspect of the invention, as set forth in the first aspect of the invention, it is preferable that the push link is connected to a brake master cylinder through a piston.

According to a fourth aspect of the invention, as set forth in the second aspect of the invention, it is preferable that the actuator unit comprises a motor, a ball screw shaft, and a ball screw nut.

According to the invention, the pedal can be moved in the anteroposterior direction of the vehicle while the lever ratio is maintained at the constant value. Thus, even when the pedal is moved in the anteroposterior direction of the vehicle, uncomfortable operational feeling is never given to the driver. Also, even when the pedal is moved in the anteroposterior direction of the vehicle, the connecting point between the swing shaft of the pedal apparatus and the push rod is not moved. Thus, the pedal apparatus has high structural reliability.

DETAILED DESCRIPTION OF EXEMPLARY EMBODIMENTS OF THE INVENTION EMBODIMENTS

Hereinafter, a best mode for carrying out the invention is described in detail. For facilitating description, a pedal apparatus for brakes is described below. Incidentally, the apparatus according to the invention is not limited to the pedal apparatus for brakes. The invention can be applied to a clutch, an accelerator, and the like. Also, the invention can be applied to boats and ships.

Figure 1:
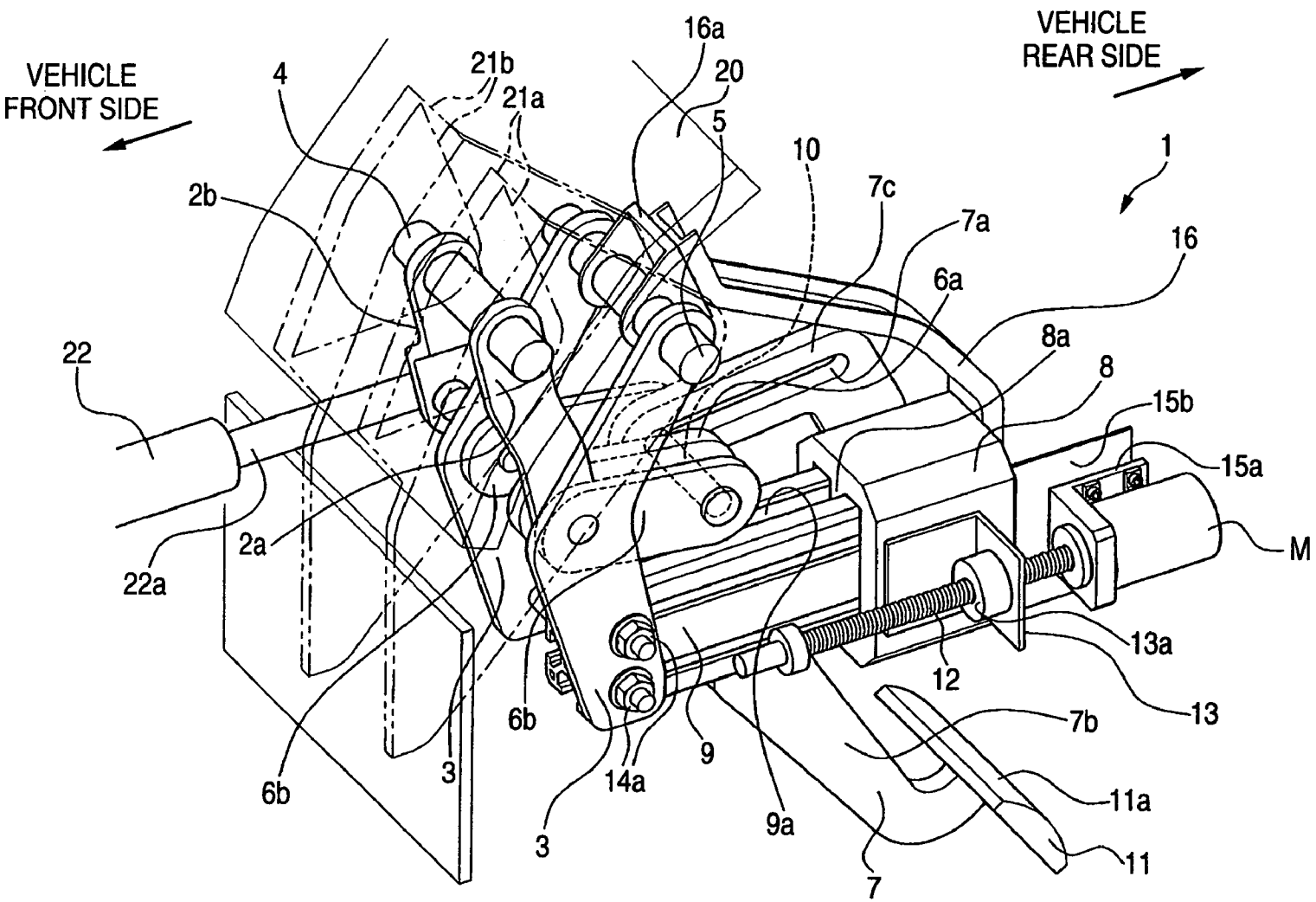
FIG. 1 is a perspective view illustrating an anteroposterior position variable pedal apparatus according to an embodiment of the invention, which is taken from the front side of a vehicle.
Figure 2:
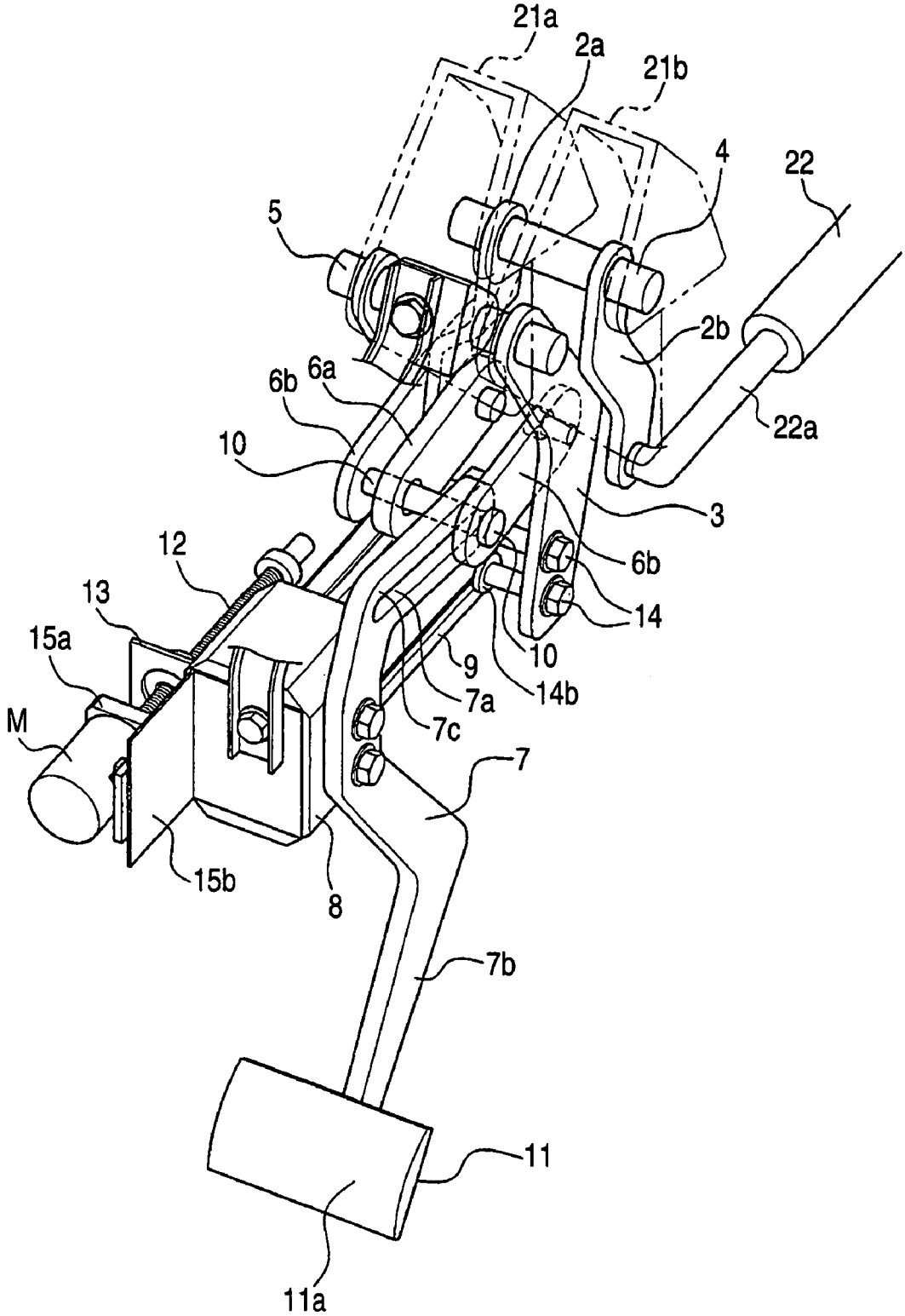
FIG. 2 is a perspective view illustrating the anteroposterior position variable pedal apparatus according to the embodiment of the invention, which is taken from the rear side of a vehicle.

First, the configuration of an anteroposterior position variable pedal apparatus according to the present embodiment by appropriately referring to FIGS. 1 and 2. FIG. 1 is a perspective view illustrating the anteroposterior position variable pedal apparatus according to the present embodiment of the invention, which is taken from the front side of the vehicle. FIG. 2 is a perspective view illustrating the anteroposterior position variable pedal apparatus according to the present embodiment of the invention, which is taken from the rear side of the vehicle.

A pedal apparatus 1 according to the present embodiment is mounted on a vehicle frame 20 through a pair of brackets 21*a* and 21*b*. A push link shaft 4 and a pedal link shaft 5, which are members constituting the pedal apparatus 1, are fixed to brackets 21*a*, 21*b*, respectively. A structure constituted by all the other members of the pedal apparatus 1 is attached to the push link shaft 4 and the pedal link shaft 5. Incidentally, the pedal link shaft 5 is fixed to the brackets 21*a*, and 21*b*, which are provided at a position rearwardly from the push link shaft 4.

The push link shaft 4 is joined with one end of each of the push links 2*a* and 2*b*. The push links 2*a* and 2*b* are adapted to be swingable around the push link shaft 4. The push links 2*a* and 2*b* swing around the push link shaft 4 in synchronization with each other. The push links 2*a* and 2*b* do not swing around the push link shaft 4 independently each other. Thus, a force received by one of the push links 2*a* and 2*b* is transmitted directly to the other of the push links 2*a* and 2*b*. One end of each of the pedal links 3 and 3 is swingingly joined with the pedal link shaft 5.

A piston 22*a* of a brake master cylinder 22 substantially horizontally disposed is swingingly joined with the push link 2*b*. When a force rotating clockwise, as viewed in FIG. 1, (hereunder referred to simply as clockwise) is applied to the push link 2*a*, the force is transmitted to the push link 2*b*. Thus the piston 22*a* is pushed in the brake master cylinder 22 toward the front of the vehicle. Consequently, the brake attached to each of wheels of the vehicle (not shown) is operated, so that a brake force is applied to the vehicle.

The other end of the push link 2*a* and end of the first connecting link 6*a* are mutually swingingly joined with each other. As shown in FIG. 2, the push link 2*a* is not a flat-plate-like link member. A surface of a part of the push link 2*a*, which is joined with the push link shaft 4, is parallel to a surface of a part of the push link 2*a*, which is joined with the first connecting link 6*a*. However, there is a step-like portion between these surfaces. The step-like portion is formed on a middle portion of the push link 2*a*. The push link 2*a* has a step-like shape so as to prevent the first connecting link 6*a*, which is joined with the push link 2*a*, and a pedal arm upper portion 7*c* (to be described later) from being mutually interfered with each other, and so as to compactify the pedal apparatus 1. The push link 2*b* has a shape similar to that of the push link 2*a*.

Each of the pedal links 3 and 3 is substantially L-shaped. Each of the second connecting links 6*b* and 6*b* is swingingly joined with a same place of the middle portion of an associated one of the pedal links 3 and 3. The other ends of the pedal links 3 and 3 are connected to each other with two bolts 14 and 14, which penetrate through a slider rail 9 and pass from one of the pedal links 3 and 3 to the other pedal link 3. Head portions of the bolts 14 and 14 are fixed to one of the pedal links 3 and 3. Each of stoppers 14*b* and 14*b* used to fix the slider rail 9 is fixed to a middle portion of an associated one of the bolts 14 and 14 (only one of the stoppers 14*b* and 14*b* is shown in FIG. 2). The bolts 14 and 14 penetrate through the slider rail 9. The stoppers 14*b* and 14*b* abut against the slider rail 9. Ends of screw portions of the bolts 14 and 14 penetrate through the other pedal link 3 and are screwed by the bolts 14 and 14. Consequently, the slider rail 9 is fixed. The pedal links 3 and 3 are maintained to be parallel to each other. The bolts 14 and 14 inhibit the slider rail 9 from swinging. Additionally, the slider rail 9 is inhibited by the stoppers 14*b* and 14*b* fixed to the bolts 14 and 14 from being moved in a lateral (width) direction of the vehicle.

A slider 8 is a member in which a punch hole having an inner shape coinciding with the outer shape of the slider rail 9 is formed. The slider 8 is engaged with the slider rail 9. Slider projection portions 8*a* and 8*a* provided on an upper portion and a lower portion of the slider 8 (only an upper one of the slider projection portions is shown in FIG. 1) engage with slider grooves 9*a* and 9*a* (only the upper slider groove 9*a* is shown in FIG. 1) provided in an upper portion and a lower portion of the slider rail 9, respectively. Thus, the slider 8 is engaged with the slider rail 9. Each of the slider projection portions 8*a* can be moved in an associated one of the slider grooves 9*a*. Thus, the slider 8 can be moved along the slider rail 9.

A slider rail bracket 15*b* is screwed into and is fixed to a vehicle rear side end portion of the slider rail 9. A ball screw bracket 13 is fixed to a vehicle left side surface of the slider 8, as viewed in FIG. 1. Also, a middle portion of a pedal arm 7 is screwed into and is thus fixed to a vehicle right side surface of the slider 8 (see FIG. 2).

A motor bracket 15*a* is screwed into and is fixed to the slider rail bracket 15*b*. Also, a motor M is fixed to the motor bracket 15*a*. A shaft (not shown) of the motor M is locked by a ball screw shaft 12. The ball screw shaft 12 passes through and is locked by a ball screw nut 13*a* provided in the ball screw bracket 13. Thus, when the motor M rotates, the ball screw shaft 12 rotates, so that the slider 8, to which the ball screw bracket 13 is fixed, moves along the slider rail 9. Accordingly, the slider 8 and the pedal arm 7 and a pedal 11, which are fixed to the slider 8, can be moved in the antero-posterior direction of the vehicle by driving the motor M to rotate. Also, the slider 8 is stopped at an arbitrary position on the slider rail 9 by stopping the rotation of the motor M. At that time, the rotation of the ball screw shaft 13 is restrained. Thus, the slider 8 is locked on the slider rail 9. The motor M, the ball screw shaft 12, and the ball screw nut 13*a* constitute the aforementioned actuator unit.

As shown in FIG. 1, a slider rail support bracket 16*a* is joined with the pedal link shaft 5. Both ends of a slider rail support 16 are screwed into the slider rail support bracket 16*a* and a vehicle rear side portion of the slider rail 9, respectively. The slider rail support bracket 16*a* can be swung around the pedal link shaft 16 in an interlocking manner with the pedal links 3 and 3. Therefore, an angle between the slider rail support bracket 16*a* and each of the links 3 and 3 is always maintained as a constant value. An end of the slider rail 9, to which the pedal arm 7, the slider 8, the motor M, and the ball screw shaft 12 are attached, is supported by the pedal links 3 and 3 which are joined with the pedal link shaft S, as described above. The other end of the slider rail 9 is supported by the slider rail support 16, both ends of which are fixed. Incidentally, when each of the members, such as the slider rail 9 and the slider 8, is made of a light weight material, the slider rail support 16 is not necessarily needed in the present embodiment.

As shown in FIGS. 1 and 2, a pedal arm lower portion 7*b* provided at a lower part of the pedal arm 7, which is fixed to the slider 8, is bent toward the rear side of the vehicle. The pedal 11 having a pedal tread surface 11*a* is fixed to an end of the pedal arm lower portion 7*b*. A pedal arm upper portion 7*c* provided at an upper part of the pedal arm 7, which is fixed to the slider 8, is bent toward the front side of the vehicle and is substantially L-shaped. An elongated guide groove 7*a* is formed in the pedal arm upper portion 7*c*. The guide groove 7*a* is not parallel to the slider rail 9. The posture of the guide groove 7*a* is downwardly declined with a predetermined downward gradient in the direction from the rear side to the front side of the vehicle with respect to a top surface of the slider rail 9.

An application point shaft 10 joined with the second connecting links 6*b* and 6*b* at both ends thereof is disposed between the second connecting links 6*b* and 6*b*. The application point shaft 10 is joined with first connecting link 61 between the second connecting links 6*b* and 6*b*, and engages with the guide groove 7*a*. The first connecting link 6*a* is enabled to swing around the application point shaft 10. The guide groove 7*a* is formed so that the width thereof is larger than the diameter of the application point shaft 10 by a predetermined tolerance. Thus, the application point shaft 10 can move in the guide groove 7*a*.

Hereinafter, an operation and an advantage of the pedal apparatus 1 are described.

First, the movement of the pedal arm 7 in the anteroposterior direction of a vehicle is described with reference to FIGS. 1 and 2. As described above, the pedal arm 7 is fixed to the slider 8. Thus, the pedal arm 7 can be moved in a direction parallel to the slider rail 9 toward the front side of the vehicle and the rear side thereof. Additionally, the elongated guide groove 7*a* has a predetermined gradient with respect to the top surface of the slider rail 9. Accordingly, when the pedal arm 7 moves in the direction parallel to the slider rail 9, the application point shaft 10 engaged with the guide groove 7*a* should be able to move in the up-down direction.

On the other hand, the second connecting links 6*b* and 6*b* joined with the application point shaft 10 can be swung with respect to the pedal links 3 and 3, respectively. Therefore, the application point shaft 10 can be swung with respect to the push link 2*a* and the pedal links 3 and 3 connected to the application point shaft 10 through the first connecting link 6*a* and the second connecting links 6*b* and 6*b*, respectively. The push link 2*a*, which is joined with the first connecting link 6*a*, can be swung with respect to the push link shaft 4. The pedal links 3 and 3 joined with the second connecting links 6*b* and 6*b* can be swung with respect to the pedal link shaft 5. Each of the swing of the first connecting link 6*a* with respect to the first connecting link 6*a* and the swing of second connecting links 6*b* and 6*b* with respect to the pedal links 3 and 3 is not obstructed by the other swing. Therefore, the application point shaft 10 moves in the guide groove 7*a* in a case where the slider 8, to which the pedal arm 7 is fixed, moves along the slider rail 9. At that time, as described above, the guide groove 7*a* is formed to have a predetermined gradient with respect to the slider rail 9. Thus, the application point shaft 10 is changed in position in the up-down direction.

Figure 3:
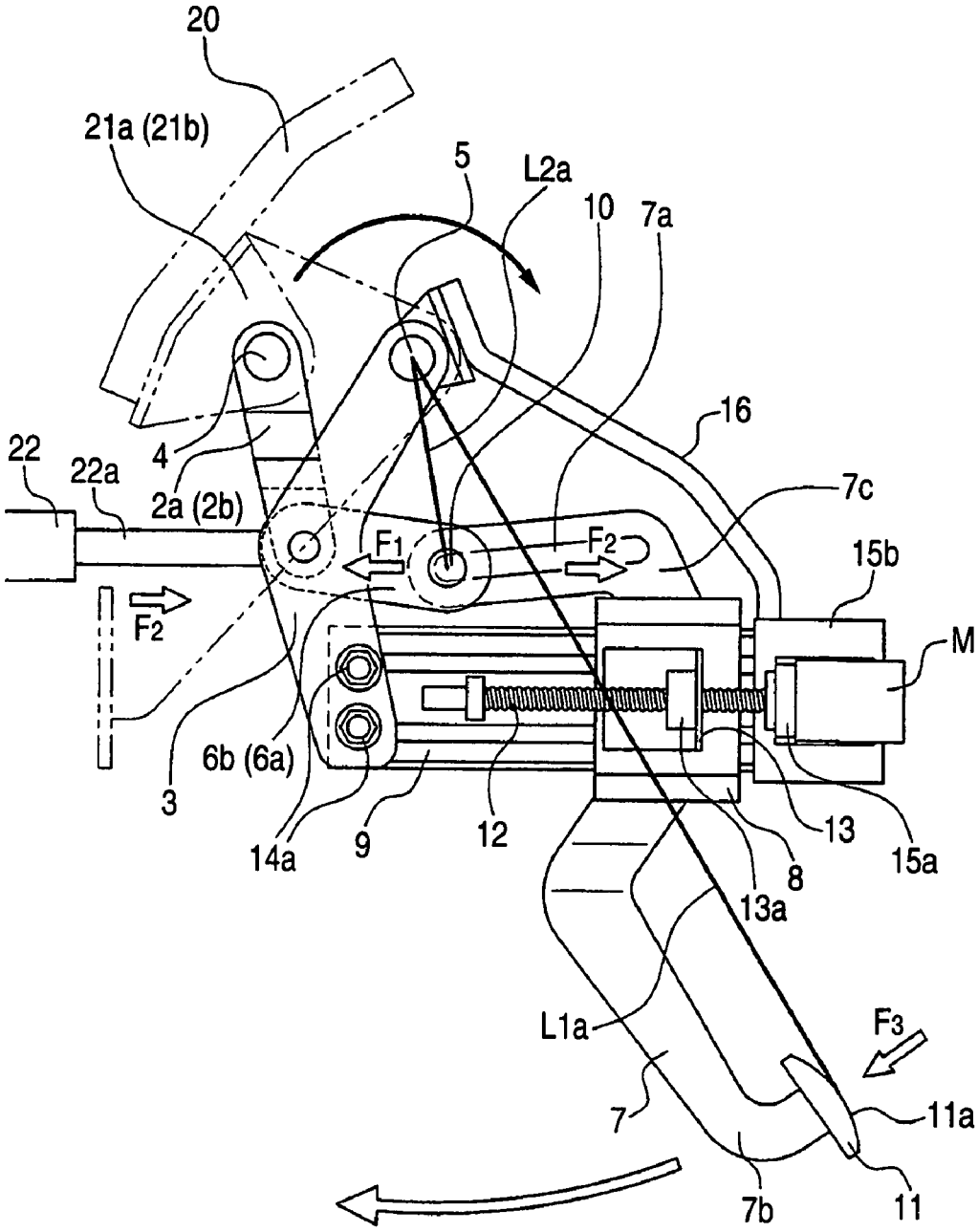
FIG. 3 is a side view illustrating a state of a pedal apparatus at a time at which a driver treads a pedal while the pedal is placed at a vehicle rear side.
Figure 4:
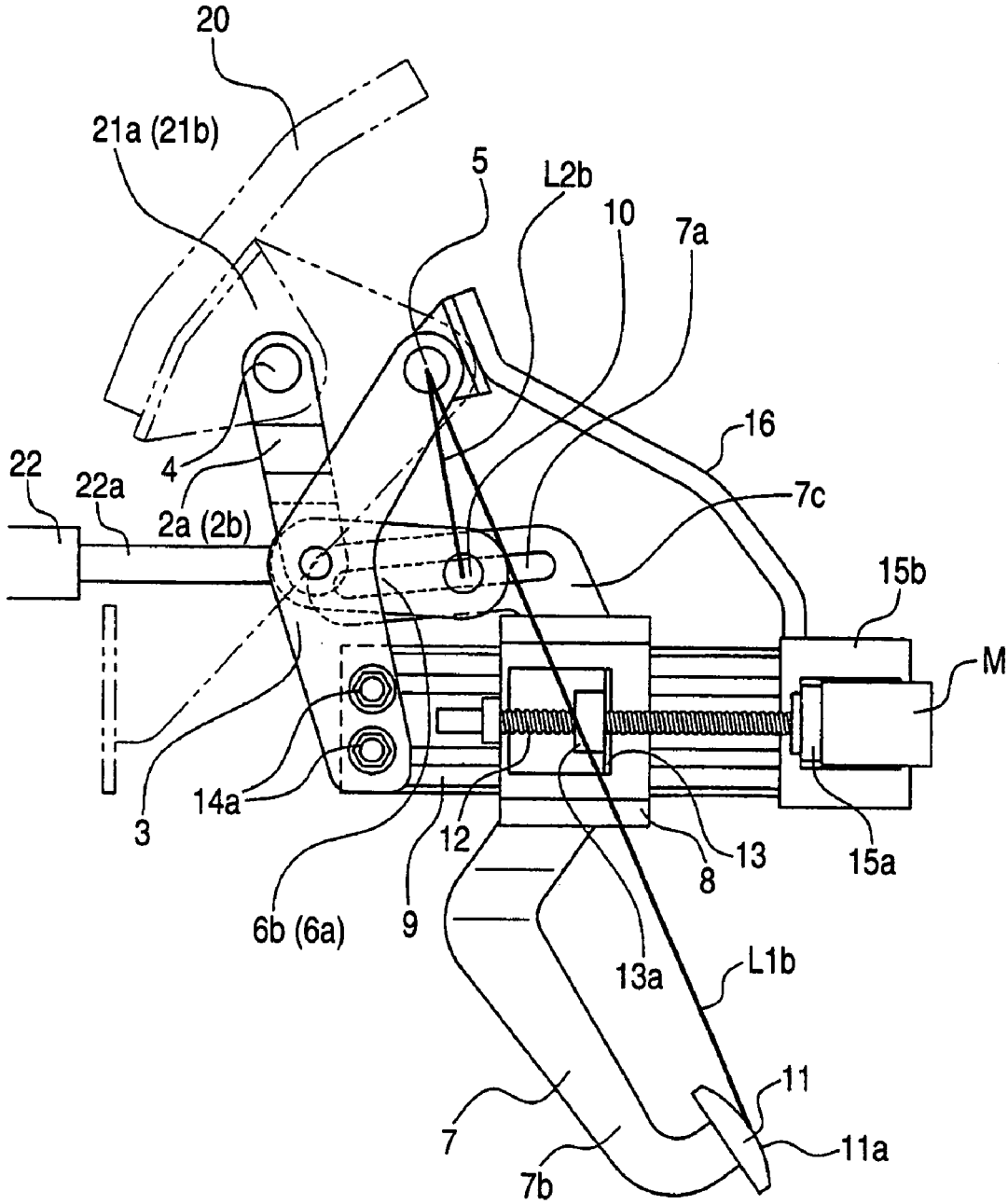
FIG. 4 is a side view illustrating a state of the pedal apparatus at a time at which the driver treads the pedal while the pedal is placed at a vehicle front side.

The up-down movement of the application point shaft 10 is described below with reference to FIGS. 3 and 4. FIG. 3 is a side view illustrating a state of the pedal apparatus at a time at which a driver treads a pedal while the pedal is placed at the rear side of the vehicle. FIG. 4 is a side view illustrating a state of the pedal apparatus at a time at which the driver treads the pedal while the pedal is placed at the front side of the vehicle.

In a state (illustrated in FIG. 3) in which the slider 8 is positioned at a vehicle rear side position on the slider rail 9, the application point shaft 10 is engaged with a relatively low position in the guide groove 7*a*. On the other hand, in a state (illustrated in FIG. 4) in which the slider arm 8, to which the pedal arm 7, is moved along the slider rail 9 and is positioned at a vehicle front side place on the slider rail 9, the application point shaft 10 is engaged with a relatively high position in the guide groove 7*a*.

Next, an operation of moving the pedal 11 in the anteroposterior direction of a vehicle in the pedal apparatus 1 according to the present embodiment is described below with reference to FIG. 5. As described above, in the pedal apparatus 1 according to the present embodiment, the pedal 11 can be moved in the anteroposterior direction of the vehicle through the ball screw shaft 12, the ball screw nut 13*a*, the ball screw bracket 13, the slider 8, and the pedal arm 7 by driving the motor M.

Figure 5:
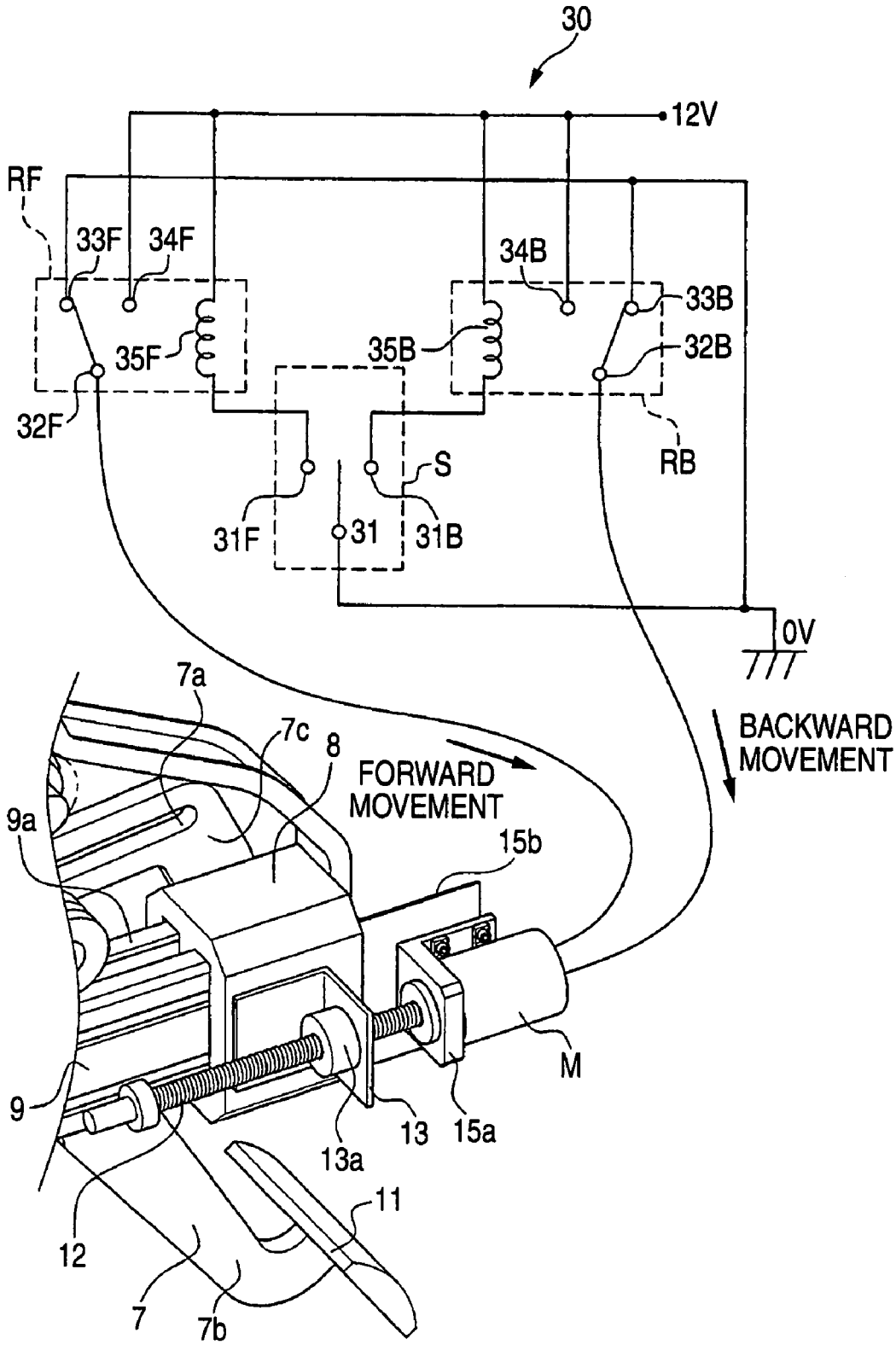
FIG. 5 is a diagram illustrating an example of a motor drive circuit adapted to move the anteroposterior position variable pedal apparatus according to the embodiment of the invention in an anteroposterior direction of the vehicle.

FIG. 5 is a diagram illustrating an example of a motor drive circuit adapted to move the anteroposterior position variable pedal apparatus according to the present embodiment in the anteroposterior direction of the vehicle.

The motor M is control by, for example, a motor drive circuit 30 shown in FIG. 5. The circuit shown in FIG. 5 includes a 12-V battery, a pair of relays RF and RB connected to the battery, and a switch S connected to the pair of relays RB and RF. The relay RF includes a coil 35F, and a relay contact 32F, a 0-V contact 33F, and a 12V-contact 34F (hereunder referred to as the "contact 32F", the "contact 33F" and the "contact 34F", respectively). The relay RB includes a coil 35B, and a relay contact 32B, a 0-V contact 33B, and a 12V-contact 34B (hereunder referred to as the "contact 32F", the "contact 33F" and the "contact 34F", respectively). The switch S includes a switch contact 31, a forward-movement-side contact 31F, and a backward-movement-side contact 31B (hereunder referred to as the "contact 31", the "contact 31F", and the "contact 31B", respectively). The switch S is attached to a position where a driver can operate the switch S.

When the motor M is in a non-driven state, the relay RF is in a state in which the contacts 32F and 33F are shortcircuited. Also, the relay RB is in a state in which the contacts 32B and 33B are shortcircuited. Also, the switch S is in a neutral state. Thus, no electric current is fed to the motor M. Additionally, the motor M is connected to the earth at both ends. Accordingly, the motor M is restricted from rotating. When the driver moves the pedal 11 toward the front side of the vehicle, the driver operates the switch S to shortcircuit the contacts 31 and 31F. Then, electric current is fed to the coil 35F of the relay RF, so that the contacts 32F and 34F are shortcircuited. Subsequently, electric current is fed to the battery, the contact 34F, the contact 32F, the motor M, the contact 32B, and the contact 33B in this order. Thus, the counterclockwise (CCW) rotation of the motor M is performed. Consequently, the pedal arm 7 and the pedal 11, which are fixed to the slider 8, are moved toward the front side of the vehicle.

When the driver moves the pedal 11 toward the backward side of the vehicle, the driver operates the switch S to shortcircuit the contacts 31 and 31B. Then, electric current is fed to the coil 35B of the relay RF, so that the contacts 32B and 34B are shortcircuited. Subsequently, electric current is fed to the battery, the contact 34B, the contact 32B, the motor M, the contact 32F, and the contact 33F, and the earth in this order. Thus, the CW rotation of the motor M is performed. Consequently, the pedal arm 7 and the pedal 11, which are fixed to the slider 8, are moved toward the backward side of the vehicle. Consequently, the driver, who sits on the driver's seat, can change the position in the anteroposterior direction of the pedal 11 for operating the brake.

Next, the change of the lever ratio, which is caused when the pedal 11 is moved in the anteroposterior direction of the vehicle in the pedal apparatus 1 according to the present embodiment, is described below with reference to FIGS. 3 and 4. When the driver steps on the pedal tread surface 11*a* in the state shown in FIG. 3, connected members, such as the pedal arm 7, the slider 8, the slider rail 9, the motor M, the pedal links 3 and 3, and the second connecting links 6*b* and 6*b*, swing clockwise around the pedal link shaft 5. In a case where these members of the pedal apparatus 1 swing clockwise around the pedal link shaft 5, the application point shaft 10 joined with the second connecting links 6*b* and 6*b* engages the guide groove 7*a*, so that the application point shaft 10 is restricted from moving in the up-down direction. Thus, similarly, the application point shaft 10 swings clockwise around the pedal link shaft 5.

On the other hand, the first connecting link 6*a* is swingingly joined with the application point shaft 10. Thus, the aforementioned clockwise swing of the application point shaft 10 around the pedal link shaft 5 of the pedal 11 is transmitted to the piston 22*a* of the brake master cylinder 22 through the application point shaft 10, the first connecting link 6*a*, and the push links 2*a* and 2*b*. Consequently, the piston 22*a* is pushed in the brake master cylinder 22 toward the front side of the vehicle. The piston 22*a* receives a reaction force $F_2$ from the brake master cylinder 22. The reaction force $F_2$ received by the piston 22*a* acts on the application point shaft 10 through the push links 2*b* and 2*a* and the first connecting link 6*a*.

On the other hand, in a case where a driver steps on the pedal tread surface 11*a* with a force F3 acting in a tangential direction of a swing circle centered at the pedal link shaft 5 of the pedal 11, a horizontal component $F_1$ of the force $F_3$ is applied to the application point shaft 10 through the pedal arm 7, the slider 8, the slider rail 9, the pedal links 3 and 3, and the second connecting links 6*b* and 6*b*. In a case where forces $F_1$ and $F_2$ applied to the application point shaft are equal in magnitude to each other, the pedal 11 is in a halting state. The piston 22*a* pushed by the push link 2*b* toward the front side of the vehicle is stopped in a state in which the piston 22*a* is pushed in the brake master cylinder 22. On the other hand, in a case where the force $F_1$ is larger in magnitude than the force $F_2$, the pedal 11 further swings around the pedal link shaft 5. The push links 2*a* and 2*b* swing clockwise around the push link shaft 4. The piston 22*a* is further pushed in the brake master cylinder 22.

Thus, in the state shown in FIG. 3, the lever ratio of the pedal apparatus 1 according to the present embodiment is a ratio ($L_{2a}/L_{1a}$) of the distance $L_{2a}$ between the pedal link shaft 5 and the application point shaft 10 to the distance $L_{1a}$ between the pedal link shaft 5 and the pedal 11.

When the pedal 11 is moved toward the front side of the vehicle, as shown in FIG. 4, the lever ratio is a ratio ($L_{2b}/L_{1b}$) of the distance $L_{2b}$ between the pedal link shaft 5 and the application point shaft 10 to the distance $L_{1b}$ between the pedal link shaft 5 and the pedal 11, similarly to the case illustrated in FIG. 3. Additionally, the lever ratio of the pedal apparatus 1 in the case illustrated in FIG. 3, in which the pedal 11 is placed at the rear side of the vehicle, is compared with the lever ratio of the pedal apparatus 1 in the case illustrated in FIG. 4, in which the pedal 11 is placed at the front side of the vehicle.

FIG. 4 illustrates a vehicle front side position of the pedal 11 having been moved in a direction parallel to the slider rail 9 from the position at the rear side of the vehicle, which is shown in FIG. 3. The distance $L_{1b}$ between the pedal link shaft 5 and the pedal 11, which is shown in FIG. 4, is set to be shorter than the distance $L_{1a}$ between the pedal link shaft 5 and the pedal 11, which is shown in FIG. 3.

On the other hand, the position of the application point shaft 10 in the state shown in FIG. 4, in which the pedal 11 is placed at the front side of the vehicle, is higher than that of the shaft 10 in the state shown in FIG. 3, in which the pedal 11 is placed at the rear side of the vehicle, due to the predetermined gradient of the guide groove 7*a* with respect to the slider rail 9. Therefore, the distance $L_{2b}$ between the pedal link shaft 5 and the application point shaft 10 shown in FIG. 4 is shorter than the distance $L_{2a}$ between the pedal link shaft 5 and the application point shaft 10 shown in FIG. 3.

As compared with the distance $L_{1a}$ shown in FIG. 3 with the distance $L_{1b}$ shown in FIG. 4, the distance $L_{1b}$ is shorter than the distance $L_{1a}$. On the other hand, as compared with the distance $L_{2a}$ shown in FIG. 3 with the distance $L_{2b}$ shown in FIG. 4, the distance $L_{2b}$ is shorter than the distance $L_{2a}$. Consequently, in either a case where the pedal 11 is placed at the rear side of the vehicle, or a case where the pedal 11 is placed at the front side of the vehicle, the lever ratio is maintained at a substantially constant value. In the case of the pedal apparatus 1 according to the present embodiment, the closer the pedal 11 is moved to the front side of the vehicle, the smaller the distance $L_{1b}$ between the pedal link shaft 5 and the pedal 11 shown in FIG. 4 becomes. Also, the application point shaft 10 engages with the upper part of the guide groove 7*a*. Thus, the distance $L_{2b}$ between the pedal link 5 and the application point shaft 10 shown in FIG. 4 is reduced. Accordingly, in the case of the pedal apparatus 1 according to the present embodiment, when the pedal 11 is moved to a given position, the lever ratio is maintained at a substantially constant value. Consequently, even when the pedal 11 is moved to a given position in the anteroposterior direction of the vehicle, the effect of the driver's stepping force, which is applied to the pedal tread surface 11*a*, on the brake does not change. Thus, when the driver operates the brake, uncomfortable operational feeling is not given to the driver.

As is apparent from the foregoing description of the operation and advantage, even when the pedal 11 is moved in the vehicle anteroposterior direction in the pedal apparatus 1 according to the present embodiment, the position of the pedal link 11 serving as the center of swing and the position of the piston 22*a* serving to push the brake master cylinder 22 do not change. Therefore, the pedal apparatus 1 according to the present embodiment is high in mechanical structure reliability, in comparison with the conventional pedal apparatus configured to maintain the lever ratio at a substantially constant value.

The anteroposterior position variable pedal apparatus according to the present invention is not limited to the aforementioned embodiment. The constituent elements of the anteroposterior position variable pedal apparatus can be changed without departing from the spirit or scope of the invention. For example, in the foregoing description of the present embodiment, a device including the motor M and the ball screw shaft 12 has been described as the actuator unit of the second pedal apparatus of the invention. However, the actuator unit of the pedal apparatus of the invention is not limited thereto. For example, an actuator unit including a feed screw mechanism adapted to move the slider 8 by manually swinging a feed screw is included by an embodiment of the invention.

While the invention has been described in connection with the exemplary embodiments, it will be obvious to those skilled in the art that various changes and modification may be made therein without departing from the present invention, and it is aimed, therefore, to cover in the appended claim all such changes and modifications as fall within the true spirit and scope of the present invention.

What is claimed is:

1. An anteroposterior position variable pedal apparatus mounted through a bracket fixed to a vehicle body frame, comprising:

a push link shaft fixed to the bracket;

a pedal link shaft which is fixed to the bracket at a position rearwardly from the push link shaft;

a push link of which one end is swingingly joined with the push link shaft;

a first connecting link of which one end is swingingly attached to the other end of the push link;

a second connecting link of which one end is swingingly joined with the pedal link;

a slider rail of which one end is fixed to the other end of the pedal link;

a slider which is engaged with the slider rail, is capable of being moved along the slider rail in an anteroposterior direction of the vehicle and is capable of being locked at an arbitrary position on the slider rail;

a pedal arm fixed to the slider; and an application point shaft joined with the other end of the second connecting link, wherein an elongated guide groove is formed in an upper portion of the pedal arm so as to be inclined in a predetermined gradient with respect to the slider rail, the pedal is fixed to a lower portion of the pedal arm, the other end of the first connecting link is swingingly joined with the application point shaft, the application point shaft engages with the guide groove, the pedal moves in the anteroposterior direction of the vehicle by changing a position of the slider along the slider rail, and while the pedal moving in the anteroposterior direction, a ratio of a distance between the pedal link shaft and the application point shaft to a distance between the pedal link shaft and the pedal is maintained at a substantially constant value, by moving the application point shaft in the guide groove.

2. The anteroposterior position variable pedal apparatus according to claim 1, further comprising:

an actuator unit which moves the slider along the slider rail and stops to lock the slider at an arbitrary point on the slider rail.

3. The anteroposterior position variable pedal apparatus according to claim 1, wherein the push link is connected to a brake master cylinder through a piston.

4. The anteroposterior position variable pedal apparatus according to claim 2, wherein the actuator unit comprises a motor, a ball screw shaft, and a ball screw nut.

* * * * *